US008584629B2

(12) United States Patent
Tour et al.

(10) Patent No.: US 8,584,629 B2
(45) Date of Patent: Nov. 19, 2013

(54) INTERSTAGE VALVE IN DOUBLE PISTON CYCLE ENGINE

(75) Inventors: Oded Tour, San Diego, CA (US); Hugo Benjamin Tour, San Diego, CA (US)

(73) Assignee: Tour Engine, Inc., San Diego, CA (US)

( * ) Notice: Subject to any disclaimer, the term of this patent is extended or adjusted under 35 U.S.C. 154(b) by 970 days.

(21) Appl. No.: 12/693,281

(22) Filed: Jan. 25, 2010

(65) Prior Publication Data

US 2010/0186689 A1 Jul. 29, 2010

Related U.S. Application Data

(60) Provisional application No. 61/205,822, filed on Jan. 24, 2009.

(51) Int. Cl.
*F02B 75/18* (2006.01)

(52) U.S. Cl.
USPC ..... 123/53.6; 123/27 R

(58) Field of Classification Search
USPC ..... 123/52.1–59.7, 60.1, 61 R–63, 67, 68, 123/69 R–72, 662, 663, 27 R
See application file for complete search history.

(56) References Cited

U.S. PATENT DOCUMENTS

| | | | | |
|---|---|---|---|---|
| 1,372,216 | A | 3/1921 | Casaday | |
| 3,069,915 | A | 12/1962 | Sawle, Jr. | |
| 3,675,630 | A * | 7/1972 | Stratton | 123/70 R |
| 3,880,126 | A | 4/1975 | Thurston et al. | |
| 3,959,974 | A | 6/1976 | Thomas | |
| 4,157,080 | A * | 6/1979 | Hill | 123/52.5 |
| 4,520,765 | A * | 6/1985 | Gerace | 123/27 R |
| 5,546,897 | A | 8/1996 | Brackett | |
| 5,623,894 | A | 4/1997 | Clarke | |
| 6,880,501 | B2 | 4/2005 | Suh et al. | |
| 7,383,797 | B2 * | 6/2008 | Tour | 123/51 BA |
| 7,516,723 | B2 * | 4/2009 | Tour | 123/51 BA |
| 2003/0015171 | A1 | 1/2003 | Scuderi | |

* cited by examiner

*Primary Examiner* — Hung Q Nguyen
(74) *Attorney, Agent, or Firm* — Morrison & Foerster LLP

(57) ABSTRACT

An interstage valve for fluidly coupling two chambers of a double-piston engine is disclosed. The interstage valve may include a main valve body, a seal, and an electric coil. When closed, the seal is coupled to the main valve body as a result of electromagnetic forces generated by the electrical coil. The interstage valve is opened when the pressure differential between the engine chambers exceeds the electromagnetic forces. As the interstage valve opens, the electromagnetic forces diminish. The electromagnetic valve moves from the open state to the closed state when the pressure differential reverses. As the seal moves toward the main valve body, the electromagnetic forces increase, coupling the seal to the main valve body.

25 Claims, 15 Drawing Sheets

Figure 14A
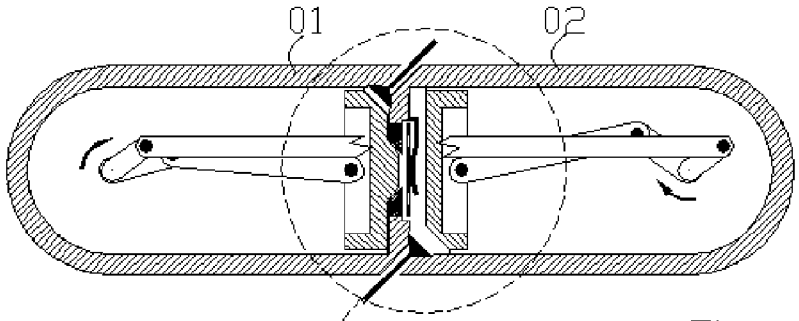
Figure 14B
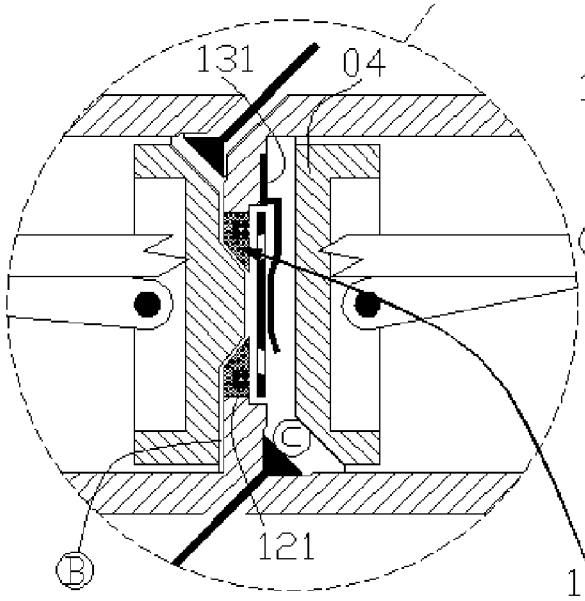
Figure 14C
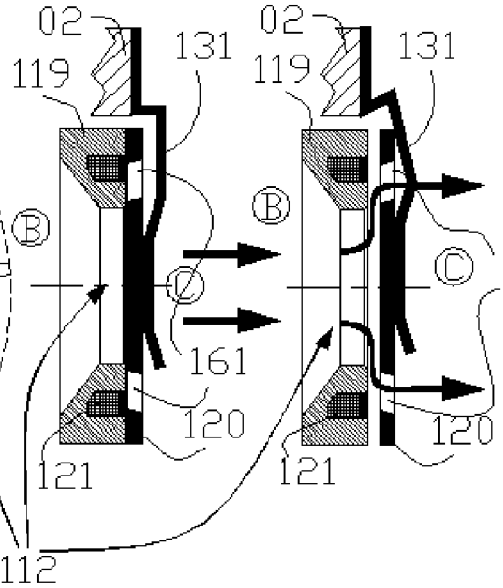
Figure 14D

Figure 15A
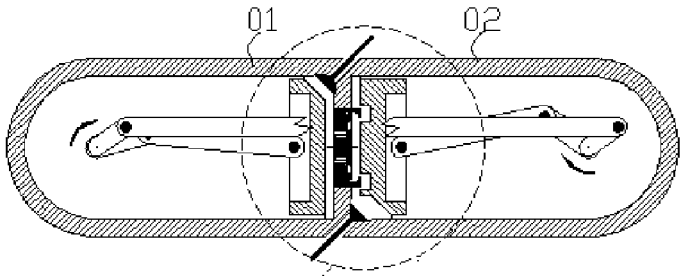
Figure 15B
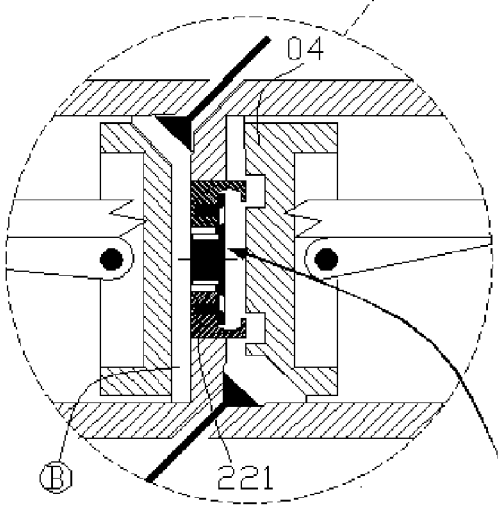
Figure 15C
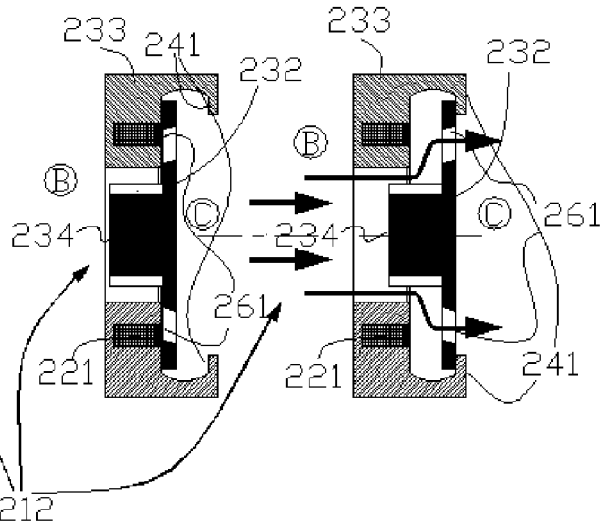
Figure 15D

INTERSTAGE VALVE IN DOUBLE PISTON CYCLE ENGINE

RELATED PATENTS

This application claims priority to U.S. Provisional Patent Application No. 61/205,822 filed Jan. 24, 2009, the content of which is incorporated by reference herein in its entirety.

BACKGROUND OF THE INVENTION

1. Field of the Invention

The present invention relates generally to split internal combustion engines and, more specifically, to a double piston cycle engine (DPCE) that is more efficient then conventional combustion engines.

2. Description of the Related Art

Conventional internal combustion engines include one or more cylinders. Each cylinder includes a single piston that performs four strokes, commonly referred to as the intake, compression, combustion/power, and exhaust strokes. Together, these four strokes form a complete cycle of a conventional internal combustion engine.

Conventional internal combustion engines have low fuel efficiency—more than one half of the potential thermal energy created by conventional engines is estimated to dissipate through the engine structure and exhaust outlet, without adding any useful mechanical work. A major cause of thermal waste in conventional internal combustion engines is the essential cooling system (e.g., radiator), which alone dissipates heat at a greater rate and quantity than the total heat actually transformed into useful work. Furthermore, conventional internal combustion engines are unable to increase efficiencies by employing low heat rejection methods in the cylinders and pistons.

Further inefficiency results from high-temperature in the cylinder during the intake and compression strokes. This high temperature reduces engine volumetric efficiency, makes the piston work harder and, hence, reduces efficiency during these strokes.

Theoretically, a larger expansion ratio than compression ratio will greatly increase engine efficiency in an internal combustion engine. In conventional internal combustion engines, the expansion ratio is largely dependent on the compression ratio. Moreover, conventional means to make the engine expansion ratio independent of the compression ratio are inefficient.

Another problem with conventional internal combustion engines is an incomplete chemical combustion process, which reduces efficiency and causes harmful exhaust emissions.

Others have previously disclosed dual-piston combustion engine configurations. For example, U.S. Pat. No. 1,372,216 to Casaday discloses a dual piston combustion engine in which cylinders and pistons are arranged in respective pairs. The piston of the firing cylinder moves in advance of the piston of the compression cylinder. U.S. Pat. No. 3,880,126 to Thurston et al. discloses a two-stroke cycle split-cylinder internal combustion engine. The piston of the induction cylinder moves somewhat less than one-half stroke in advance of the piston of the power cylinder. The induction cylinder compresses a charge, and transfers the charge to the power cylinder where it is mixed with a residual charge of burned products from the previous cycle, and further compressed before igniting. U.S. Pat. Application No. 2003/0015171 A1 to Scuderi discloses a four-stroke cycle internal combustion engine. A power piston within a first cylinder is connected to a crankshaft and performs power and exhaust strokes of the four-stroke cycle. A compression piston within a second cylinder is also connected to the crankshaft and performs the intake and compression strokes of the same four-stroke cycle during the same rotation of the crankshaft. The power piston of the first cylinder moves in advance of the compression piston of the second cylinder. U.S. Pat. No. 6,880,501 to Suh et al. discloses an internal combustion engine that has a pair of cylinders, each cylinder containing a piston connected to a crankshaft. One cylinder is adapted for intake and compression strokes. The other cylinder is adapted for power and exhaust strokes. U.S. Pat. No. 5,546,897 to Brackett discloses a multi-cylinder reciprocating piston internal combustion engine that can perform a two, four, or diesel engine power cycle.

However, these references fail to disclose how to differentiate cylinder temperatures to effectively isolate the firing (power) cylinders from the compression cylinders and from the surrounding environment. In addition, these references fail to disclose how to minimize mutual temperature influence between the cylinders and the surrounding environment. Further, these references fail to disclose engine improvements that enhance conventional internal combustion engine efficiency and performance by raising the firing cylinder temperature and lowering the compression cylinder temperature. Specifically, increasing power cylinder temperature allows for increased energy production, while minimizing compression cylinder temperature allows for reduced energy investment. In addition, the separate cylinders disclosed in these references are all connected by a transfer valve or intermediate passageway of some sort that yields a volume of "dead space" between cylinders. Dead space between cylinders reduces maximum available crankshafts phase angle shift and therefore further degrades the efficiency of the engine. Additionally, none of the references discussed above teach an opposed or "V" cylinder and crankshaft configuration that minimizes dead space and maintains an improved temperature differential between the cylinders through isolation.

U.S. Pat. No. 5,623,894 to Clarke discloses a dual compression and dual expansion internal combustion engine. An internal housing, containing two pistons, moves within an external housing thus forming separate chambers for compression and expansion. However, Clarke contains a single chamber that executes all of the engine strokes. As noted above, a single chamber prevents isolation and/or improved temperature differentiation of cylinders such as those disclosed in embodiments of the present invention.

U.S. Pat. No. 3,959,974 to Thomas discloses an internal combustion engine including a combustion cylinder constructed, in part, of material capable of withstanding high temperatures and a power piston having a ringless section, also capable of withstanding high temperatures, connected to a ringed section which maintains a relatively low temperature. However, elevated temperatures in the entire Thomas engine reside not only throughout the combustion and exhaust strokes, but also during part of the compression stroke. Further, Thomas fails to disclose a method of isolating the engine cylinders in an opposed or "V" configuration to permit improved temperature differentiation and discloses an engine containing substantial dead space in the air intake port connecting the cylinders.

Further, none of the prior art references disclose a split internal combustion engine wherein an electromagnetic interstage valve is biased by an electromagnetically generated biasing force in a closed state.

SUMMARY OF THE INVENTION

In view of the foregoing disadvantages inherent in the known types of internal combustion engine now present in the prior art, embodiments of the present invention include a DPCE combustion engine utilizing temperature differentiated cylinders that converts fuel into energy or work in a more efficient manner than conventional internal combustion engines.

In an exemplary embodiment of the present invention, a DPCE engine includes a first cylinder coupled to a second cylinder, a first piston positioned within the first cylinder and configured to perform intake and compression strokes but not exhaust strokes, and a second piston positioned within the second cylinder and configured to perform power and exhaust strokes but not intake strokes. Alternatively, the first and second cylinders can be considered as two coupled, but separate, chambers of a single cylinder, wherein the first piston resides in the first chamber and the second piston resides in the second chamber.

In a further exemplary embodiment, a DPCE engine further includes an intake valve coupled to the first cylinder, an exhaust valve coupled to the second cylinder and an interstage valve that couples an internal chamber of the first cylinder to an internal chamber of the second cylinder.

In a further exemplary embodiment, the engine includes two piston connecting rods, a compression crankshaft, a power crankshaft and two crankshaft connecting rods. The connecting rods connect respective pistons to their respective crankshafts. The compression crankshaft converts rotational motion into reciprocating motion of the first piston. The power crankshaft converts second piston reciprocating motion into engine rotational output motion. The compression crankshaft relative angle with regard to the power crankshaft relative angle differ from each other by implementing a phase angle delay such that the piston of the power cylinder moves in advance of the piston of the compression cylinder. The crankshaft connecting rods transfer the power crankshaft rotation into compression crankshaft rotation.

In some exemplary embodiments, the interstage valve includes an electromagnetically generated biasing force that biases the interstage valve in a closed position.

In further exemplary embodiments, the interstage valve opens when a pressure differential force, including the force generated by a pressure differential between the first and second cylinders, exceeds a biasing force generated by an electrical coil in the interstage valve. As an exemplary advantage to this embodiment, the magnitude of pressure differential between the first and second cylinders required to open the valve may be controlled by varying the current in the coil. As a further exemplary advantage, the magnitude of the electromagnetically generated biasing force decreases as the interstage valve opens further. In some exemplary embodiments, the pressure in the first cylinder is compression pressure in a double piston cycle engine.

In some embodiments, the interstage valve opens to a position defined by a stop. Further, the interstage valve may be biased in the open position by an electromagnetically generated biasing force. As an exemplary advantage to this embodiment, the magnitude of pressure differential between the second and first cylinders required to close the valve may be controlled by varying the current in the coil.

In a still further embodiment, the interstage valve closes when the pressure in the second cylinder exceeds the pressure in the first cylinder. In some exemplary embodiments, the pressure in the second cylinder is combustion pressure in a double piston cycle engine. Because the opening and closing of the interstage valve is facilitated by pressure differentials between first and second cylinder, the interstage valve need produce only a relatively small magnitude of electromagnetically generated force. In some embodiments, the closing of the interstage valve may be assisted by a mechanical bias.

In one exemplary embodiment, the intake valve is composed of a shaft having a conic shaped sealing surface, the same as is used in the intake valves in most four stroke engines. The exhaust valve is composed of a shaft having a conic shaped sealing surface, as is commonly known in the art. In one embodiment, the interstage valve includes an electromagnetic valve that is operable to open and close by utilizing electrical current in combination with the upstream and downstream pressure differential. As an added advantage to this embodiment, the timing of the valve operation is controlled by varying electrical current.

In some exemplary embodiments, a method of improving combustion engine efficiency includes separating the intake and compression chamber (cool strokes) from the combustion and exhaust chamber (hot strokes), and thus enabling reduced temperature during intake and compression strokes and increased temperature during the combustion stroke, thereby increasing engine efficiency.

In some exemplary embodiments, a method of improving engine efficiency includes minimizing or reducing the temperature during intake and compression strokes. The lower the incoming and compressed air/charge temperature is, the higher the engine efficiency will be.

In some exemplary embodiments, a method of improving engine efficiency includes insulating and thermally enforcing the power piston and cylinder to operate under higher temperatures.

In some exemplary embodiments, a method of improving engine efficiency includes external isolating of the power cylinder.

In some exemplary embodiments, a DPCE engine is provided that greatly reduces external cooling requirements, which increases the potential heat available for heat output work conversion during the power stroke. Thus, fuel is burned more efficiently, thereby increasing overall efficiency and decreasing harmful emissions.

In some exemplary embodiments, a method of providing an improved efficiency combustion engine includes performing the intake and compression but not the exhaust strokes in a first cylinder and performing the power and exhaust strokes but not the intake strokes in a second cylinder, wherein the first cylinder is maintained at a cooler temperature than the second cylinder.

In some exemplary embodiments, a method of providing a more efficient internal combustion engine includes performing the intake and compression strokes, but not the exhaust stroke, in a first cylinder and performing the power and exhaust strokes, but not the intake stroke, in a second cylinder, wherein the first cylinder volume is smaller then the second cylinder volume. Disparate cylinder volumes provide for additional energy conversion in the combustion chamber.

BRIEF DESCRIPTION OF THE DRAWINGS

FIGS. 14A-D are simplified cross-sectional illustrations of an electromagnetic interstage valve with a leaf spring for biasing the seal.

FIGS. 15A-D are simplified cross-sectional illustrations of an electromagnetic interstage valve illustrating various valve operating states.

DETAILED DESCRIPTION OF EXEMPLARY EMBODIMENTS

The invention is described in detail below with reference to the figures, wherein similar elements are referenced with similar numerals throughout. It is understood that the figures are not necessarily drawn to scale. Nor do they necessarily show all the details of the various exemplary embodiments illustrated. Rather, they merely show certain features and elements to provide an enabling description of the exemplary embodiments of the invention.

Figure 1:
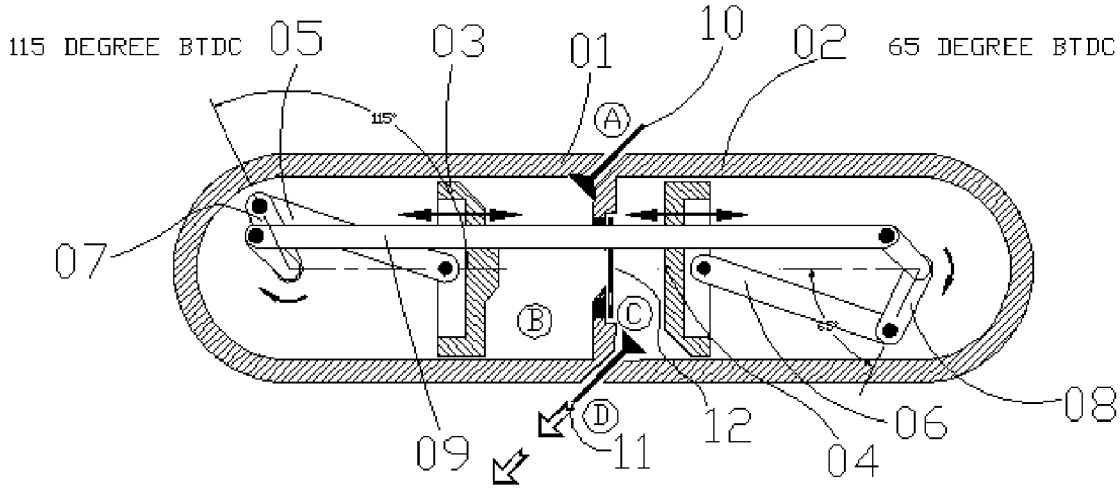
FIG. 1 is a simplified cross-sectional side view of a DPCE apparatus, in accordance with exemplary embodiments of the present invention, wherein the compression crankshaft angle is illustrated at 115 degrees before the compression piston reaches its Top Dead Center (TDC) and the power crankshaft angle is illustrated at 65 degrees before the power piston reaches its TDC.

Referring to FIG. 1, in accordance with one embodiment of the present invention, a DPCE cylinder includes: a compression cylinder 01, a power cylinder 02, a compression piston 03, a power piston 04, two respective piston connecting rods 05 and 06, a compression crankshaft 07, a power crankshaft 08, a crankshaft connecting rod 09, an intake valve 10, an exhaust valve 11 and an interstage valve 12. The compression cylinder 01 is a piston engine cylinder that houses the compression piston 03, the intake valve 10, part of the interstage valve 12 and optionally a spark plug (not shown) located in front of the surface of compression piston 03 facing the compression chamber in cylinder 01. The power cylinder 02 is a piston engine cylinder that houses the power piston 04, the exhaust valve 11, part of the interstage valve 12 and optionally a spark plug (not shown) located in front of the surface of the power piston facing the combustion chamber in cylinder 02. The compression piston 03 serves the intake and the compression engine strokes. The power piston 04 serves the power and the exhaust strokes. The connecting rods 05 and 06 connect their respective pistons to their respective crankshafts. The compression crankshaft 07 converts rotational motion into compression piston 03 reciprocating motion. The reciprocating motion of the power piston 04 is converted into rotational motion of the power crankshaft 08, which is converted to engine rotational motion or work (e.g., the power crankshaft may also serve as the DPCE output shaft). The crankshaft connecting rod 09 translates the rotation of power crankshaft 08 into rotation of the compression crankshaft 07.

In exemplary embodiments, predetermined phase delay is introduced via the crankshafts 07 and 08, such that power piston 04 moves in advance of compression piston 03.

In exemplary embodiments of the present invention, the intake valve 10 is composed of a shaft having a conic shaped sealing surface, as is commonly known in the art. The intake valve 10, located on the compression cylinder 01, governs the ambient air or the carbureted air/fuel charge as they flow into the compression cylinder 01. The compression cylinder 01 has at least one intake valve. In some embodiments of the present invention, the intake valve location, relative to the position of compression piston 03, function, and operation may be similar or identical to the intake valves of conventional four-stroke internal combustion engines. The location of the compression piston 03 when the intake valve opens may vary. In some embodiments of the present invention, the timing of the opening of the intake valve may vary. In one example, the intake valve may open a few crankshaft degrees before the compression piston 03 reaches its TDC through approximately 50 crankshaft degrees after the compression piston 03 reaches its TDC. As used herein, "crankshaft degrees" could be understood to refer to a portion of a crankshaft rotation, a full rotation equaling 360-degrees.

In exemplary embodiments of the present invention, the exhaust valve 11 is composed of a shaft having a conic shaped sealing surface, as is commonly known in the art. The exhaust valve 11, located on the power cylinder 02 governs the flow of burned gases. The power cylinder 02 has at least one exhaust valve. In some embodiments, the exhaust valve location, functions and operation method may be similar or identical to exhaust valves of conventional four-stroke internal combustion engines. The location of the power piston 04 when the exhaust valve closes may vary. In some embodiments, the exhaust valve may close approximately 15 crankshaft degrees before power piston 04 reaches its TDC through approximately 5 crankshaft degrees after power piston 04 reaches its TDC.

In one embodiment, the interstage valve 12 is composed of a unique electromagnetic valve in which predetermined electrical current levels produce mechanical forces that dictate valve retention in the closed state (preventing working fluid transfer) followed by an exact valve cracking to the open state (permitting working fluid transfer). In one embodiment, this valve cracking to the open state is performed when a compression pressure overcomes the electromagnetic retention force.

Figure 4:
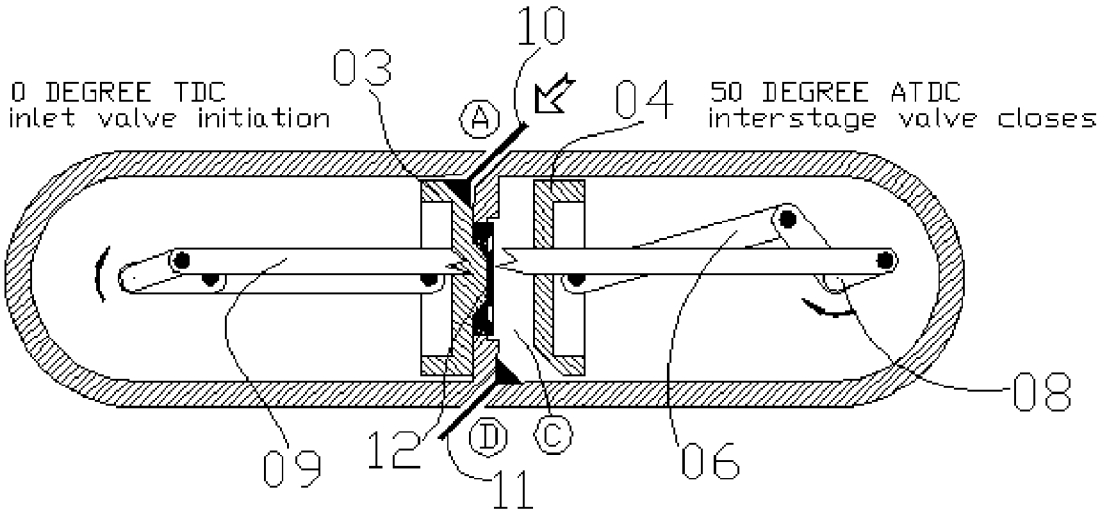
FIG. 4 is a simplified cross-sectional side view of the DPCE apparatus of FIG. 1, wherein the compression crankshaft angle is illustrated at its TDC, and the power crankshaft angle is illustrated at 50 degrees ATDC.
Figure 5:
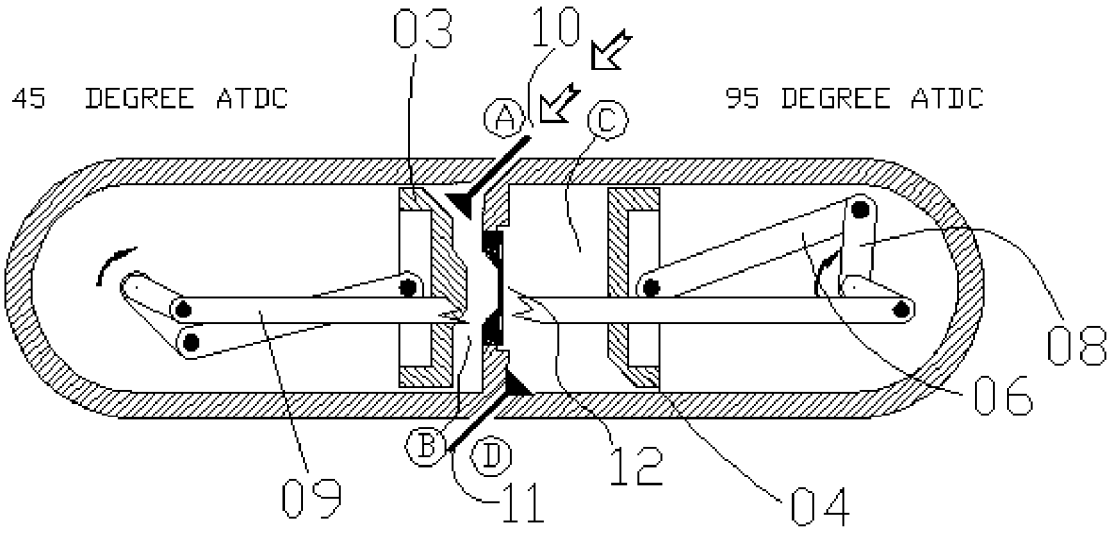
FIG. 5 is a simplified cross-sectional side view of the DPCE apparatus of FIG. 1, wherein the compression crankshaft angle is illustrated at 45 degrees ATDC, and the power crankshaft angle is illustrated at 95 degrees ATDC.
Figure 6:
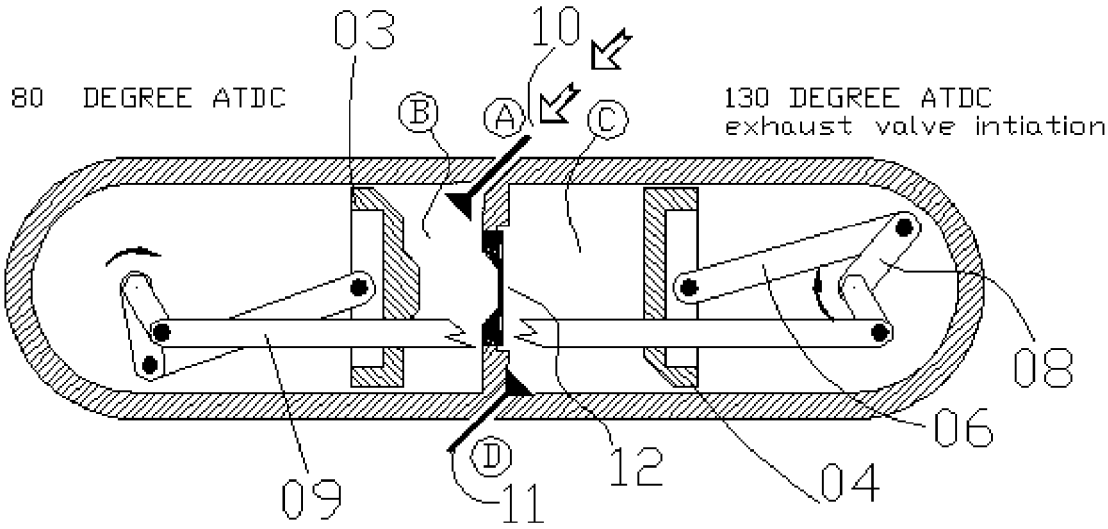
FIG. 6 is a simplified cross-sectional side view of the DPCE apparatus of FIG. 1, wherein the compression crankshaft angle is illustrated at 80 degrees ATDC, and the power crankshaft angle is illustrated at 130 degrees ATDC.
Figure 7:
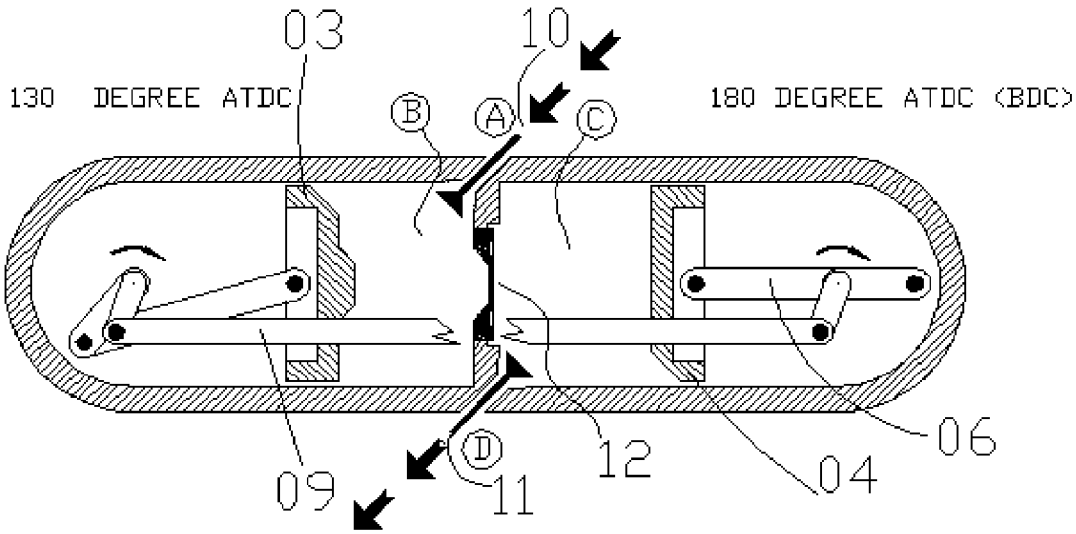
FIG. 7 is a simplified cross-sectional side view of the DPCE apparatus of FIG. 1, wherein the compression crankshaft angle is illustrated at 130 degrees ATDC, and the power crankshaft angle is illustrated at its Bottom Dead Center (BDC).
Figure 8:
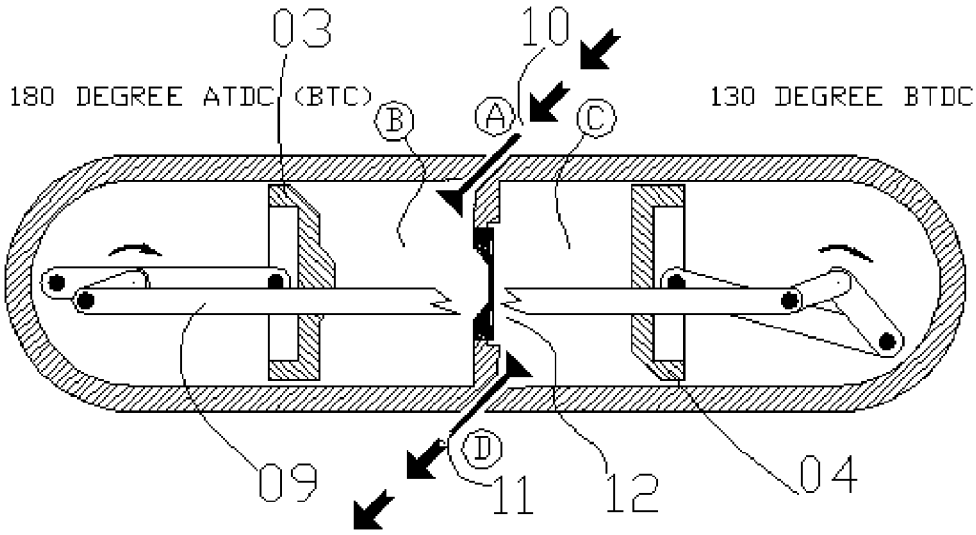
FIG. 8 is a simplified cross-sectional side view of the DPCE apparatus of FIG. 1, wherein the compression crankshaft angle is illustrated at BDC and the power crankshaft angle is illustrated at 130 degrees BTDC.
Figure 9:
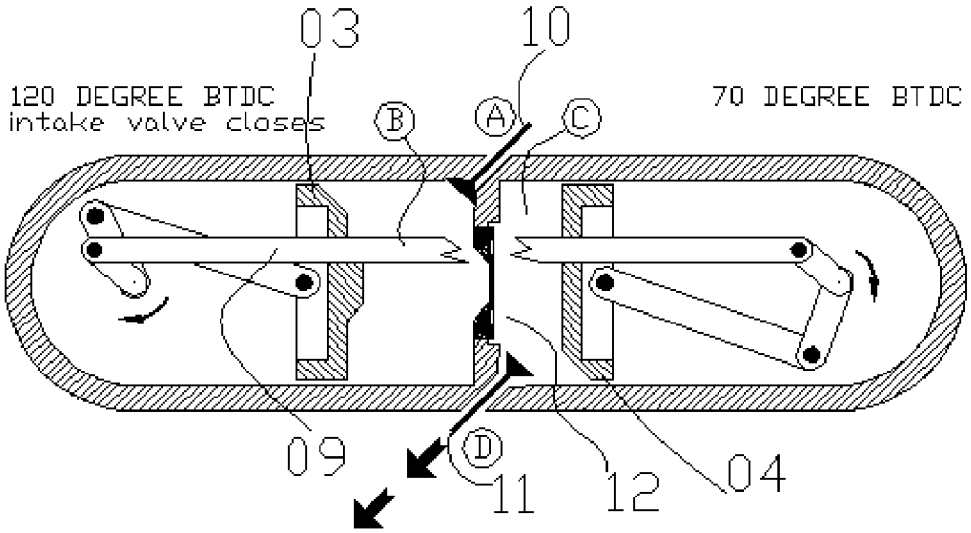
FIG. 9 is a simplified cross-sectional side view of the DPCE apparatus of FIG. 1, wherein the compression crankshaft angle is illustrated at 120 degrees BTDC, and the power crankshaft angle is illustrated at 70 degrees BTDC.

Referring again to FIG. 1, within the compression cylinder 01 is compression piston 03. The compression piston 03 moves relative to the compression cylinder 01 in the direction as indicated by the illustrated arrows. Within the power cylinder 02 is a power piston 04. The power piston 04 moves relative to the power cylinder 02 in the direction as indicated by the illustrated arrows. The compression cylinder 01 and the compression piston 03 define chamber B. The power cylinder 02 and the power piston 04 define chamber C. In some embodiments, the compression crankshaft angle trails the power crankshaft angle such that the power piston 04 moves in advance of the compression piston 03. Chamber B may be in fluid communication with chamber C when interstage valve 12 is in an open state. Chamber B, through intake valve 10, may be in fluid communication with carbureted fuel/air charge A. Chamber C, through exhaust valve 11, may be in fluid communication with ambient air D. When in an open state, exhaust valve 11 allows exhaust gases to exhale. During a combustion stroke, the power piston 04 may push the power connecting rod 06, causing the power crankshaft 08 to rotate clockwise as illustrated in FIGS. 4, 5, and 6. During an exhaust stroke, inertial forces (which may be initiated by a flywheel mass—not shown) cause the power crankshaft 08 to continue its clockwise rotation, and cause the power connecting rod 06 to move power piston 04, which in turn exhales burnt fuel exhaust through valve 11 as illustrated in FIGS. 7, 8 and 9. The power crankshaft 08 rotation articulates rotation, through a crankshaft connecting rod 09, of the compression crankshaft 07 for phase shifted synchronous rotation (i.e., both crankshafts rotate at the same speed but differ in their dynamic angles). In exemplary embodiments, the relative positions of the power piston 04 and the compression piston 03 may be phase-shifted by a desired amount to achieve a desired engine compression ratio. In other exemplary embodiments, the DPCE dual cylinder apparatus utilizes conventional pressurized cooling and oil lubrication methods and systems (not shown). In some exemplary embodiments, the components of the power chamber C are temperature controlled using a cooling system, thereby cooling the power chamber C structure components (such as the cylinder 02, piston 04, and parts of interstage valve 12). Moreover, in some exemplary embodiments, some or all of the components may be fabricated out of high-temperature resistant materials such as ceramics or ceramic coating, carbon, titanium, nickel-alloy, nanocomposite, or stainless steel. In some exemplary embodiments, the DPCE apparatus can utilize well-known high voltage timing and spark plugs electrical systems (not shown), interstage electromagnetic valve electrical current and time switching devices (not shown), as well as an electrical starter motor to control engine initial rotation.

As explained above, the compression connecting rod 05 connects the compression crankshaft 07 with the compression piston 03 causing the compression piston 03 to move relative to the cylinder in a reciprocating manner. The power connecting rod 06 connects the power crankshaft 08 with the power piston 04. During the combustion phase, the power connecting rod 06 transfers the reciprocating motion of the power piston 04 into the power crankshaft 08, causing the power crankshaft to rotate. During the exhaust phase, the power crankshaft 08 rotation and momentum pushes the power piston 04 back toward the compression cylinder 01, which causes the burned gases to be exhaled via the exhaust valve (exhaust stroke).

Referring to FIG. 1, the compression crankshaft 07 converts rotational motion into compression piston 03 reciprocating motion. The compression crankshaft 07 connects the compression connecting rod 05 with the crankshaft connecting rod 09. Motion of the crankshaft connecting rod 09 causes the compression crankshaft 07 to rotate. Compression crankshaft 07 rotation produces motion of the compression connecting rod 05 that in turn moves the compression piston 03 relative to its cylinder housing 01 in a reciprocating manner.

In various exemplary embodiments of the present invention, the compression crankshaft 07 and power crankshaft 08 structural configurations may vary in accordance with desired engine configurations and designs. For example, possible crankshaft design factors may include: the number of dual cylinders, the relative cylinder positioning, the crankshaft gearing mechanism, and the direction of rotation.

The power crankshaft 08 connects the power connecting rod 06 with the crankshaft connecting rod 09. As combustion occurs, the reciprocating motion of power piston 04 causes, through the power connecting rod 06, the power crankshaft 08, which may also be coupled to the engine output shaft (not shown), to rotate, which causes the connecting rod 09 to rotate the compression crankshaft 07, thereby generating reciprocating motion of the compression piston 03 as described above.

The crankshaft connecting rod 09 connects the power crankshaft 08 with the compression crankshaft 07 and thus provides both crankshafts with synchronous rotation. Alternative embodiments of the present invention may include, for the crankshaft connecting rod 09, standard rotational energy connecting elements such as: timing belts, multi rod mechanisms gears (See U.S. Pat. No. 3,069,915, which is incorporated by reference herein in its entirety), drive shafts combined with 90 degrees helical gear boxes and/or combination of the above.

FIGS. 1 through 9 illustrate perspective views of the crankshaft connecting rod 09 coupled to crankshafts 07 and 08, which are coupled to respective piston connecting rods 05 and 06. The crankshafts 07 and 08 may be relatively oriented so as to provide a predetermined phase difference between the otherwise synchronous motion of pistons 03 and 04. A predetermined phase difference between the TDC positions of the compression piston and power piston may introduce a relative piston phase delay or advance. FIGS. 1 through 9 illustrate that piston connecting rods 05 and 06 are out of phase, thereby providing a desired phase delay or advance between the TDC positions of pistons 03 and 04. In exemplary embodiments, as illustrated in FIGS. 1 to 9, a phase delay is introduced such that the power piston 04 moves slightly in advance of compression piston 03, thereby permitting the compressed charge to be delivered under nearly the full compression stroke and permitting the power piston 04 to complete a full exhaust stroke. Such advantages of the phase delays where the power piston leads the compression piston are also described in U.S. Pat. No. 1,372,216 to Casaday and U.S. Pat. Application No. 2003/0015171 A1 to Scuderi, the entire contents of both of which are incorporated herein in their entireties.

Figure 2:
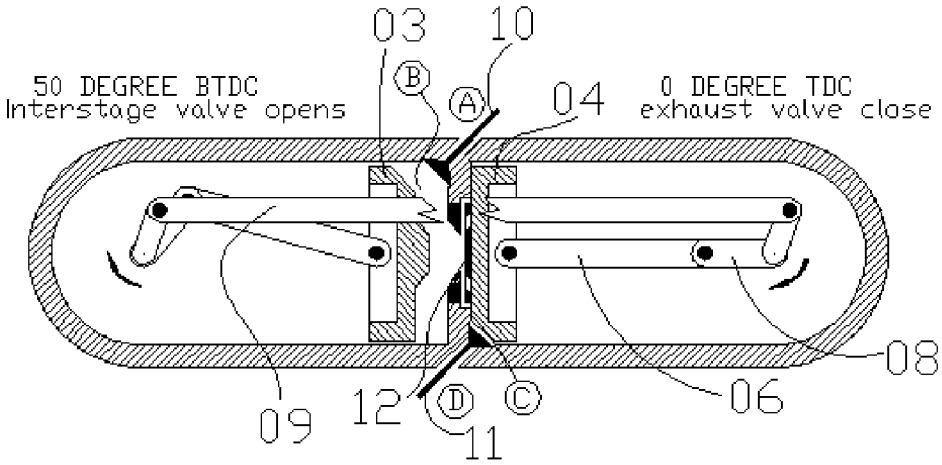
FIG. 2 is a simplified cross-sectional side view of the DPCE apparatus of FIG. 1, wherein the compression crankshaft angle is illustrated at 50 degrees before its TDC (BTDC), and the power crankshaft angle is illustrated at its TDC.
Figure 3:
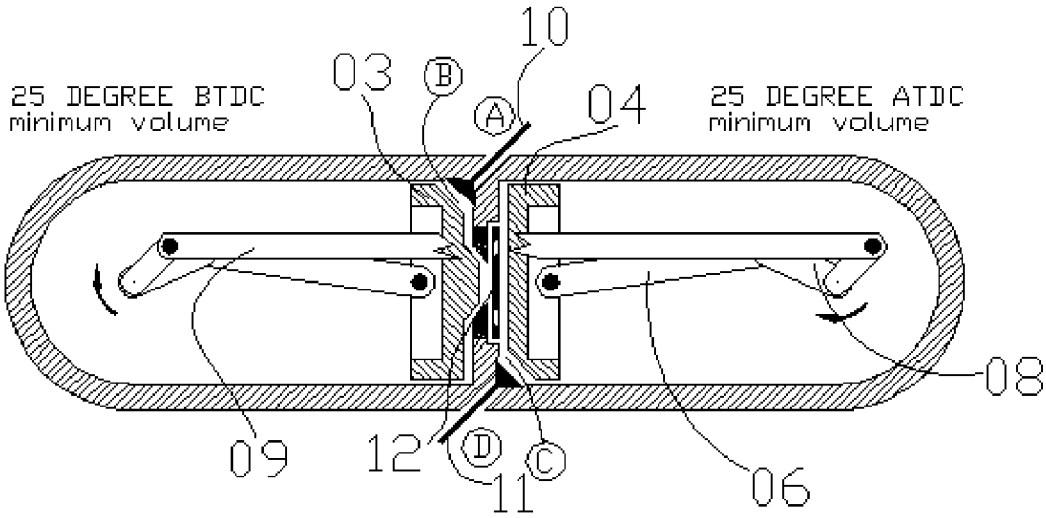
FIG. 3 is a simplified cross-sectional side view of the DPCE apparatus of FIG. 1, wherein the compression crankshaft angle is illustrated at 25 degrees BTDC, and the power crankshaft angle is illustrated at 25 degrees after its TDC (ATDC).

As illustrated in FIGS. 1 through 9, while an electrical starter engages DPCE output shaft (not shown), both crankshafts 07 and 08 start their clockwise rotation and both pistons 03 and 04 begin their reciprocating motion. As illustrated in FIG. 5, the compression piston 03 and the power piston 04 move in the direction that increases chamber B and chamber C volume. Since intake valve 10 is in its open state and because chamber B volume constantly increases at this stage, carbureted fuel or fresh air charge (when using a fuel injection system) flows from point A (which represents a carburetor output port, for example) through intake valve 10 into chamber B. The location of the compression piston 03 when the intake valve opens may vary. In some embodiments of the present invention, the timing of the opening of the intake valve may vary. In one example, the intake valve may open a few crankshaft degrees before compression piston 03 reaches its TDC through approximately −50 crankshaft degrees after compression piston 03 reaches its TDC. As shown in FIGS. 6 through 8, respectively, chamber B volume increases while fuel-air charge flows in. As compression piston 03 passes beyond its BDC point (preferably somewhere between 50 to 70 degrees after BDC, as shown in FIG. 9), intake valve 10 closes, trapping chamber B air-fuel charge content. While crankshafts clockwise rotation continues (as shown in FIG. 9 and FIG. 1), chamber B volume decreases and the temperature and pressure of the air-fuel charge increases. As the power piston 04 passes through power piston TDC (FIG. 2), interstage valve 12 opens and the air-fuel charge in chamber B flows into chamber C (FIG. 3). At a certain predetermined point (preferably, while the compression piston moves toward its TDC, as illustrated in FIGS. 2 through 4, although, some exemplary embodiments may introduce delay or advance), combustion of the air-fuel charge is initiated via an ignition mechanism, such as spark plug firing or compression ignition. As the compression piston 03 passes through its TDC (FIG. 4), interstage valve 12 closes.

FIGS. 2 through 6 illustrate the power stroke, according to exemplary embodiments of the present invention. As combustion occurs (spark plug firing or compression ignition at a predetermined piston location shown within the dynamic range illustrated in FIGS. 2 through 4, although some deviation may be permitted), the pressures of chambers B and C increase, forcing power piston 04 and compression piston 03 away from each other. Although the torque produced by the compression piston opposes engine rotation, the torque produced by the power piston during the power stroke is greater and the net torque turns the power crankshaft clockwise (as well as the coupled compression crankshaft). Meanwhile, because of increasing pressure in chamber C and decreasing pressure in chamber B, the interstage valve 12 closes (FIG. 4).

Referring now to FIGS. 4 and 5, when compression piston 03 is pulled back from its TDC position, according to exemplary embodiments of the present invention, intake valve 10 reopens, thus allowing a new air fuel charge A to enter chamber B.

In exemplary embodiments of the present invention, the exhaust stroke may begin about 40 to 60 crankshaft degrees before power piston 04 reaches its Bottom Dead Center position (FIG. 6). The exhaust valve 11 opens and the burned exhaust gases are pushed out from chamber C through open exhaust valve 11 into the ambient environment D. Although the timing of the strokes of the engine is given in exemplary embodiments, it should be understood that the timing described herein may be adjusted in some embodiments.

Thus, the DPCE engine divides the strokes performed by a single piston and cylinder of conventional internal combustion engines into two thermally differentiated cylinders in which each cylinder executes half of the four-stroke cycle. A relatively "cold" cylinder executes the intake and compression, but not the exhaust stroke, and a thermally isolated "hot" cylinder executes the combustion and exhaust, but not the intake stroke. Compared to conventional engines, this innovative system and process enables the DPCE engine to work at higher combustion chamber temperatures and at lower intake and compression chamber temperatures. Utilizing higher combustion temperatures while maintaining lower intake and compression temperatures reduces engine cooling requirements, lowers compression energy requirements, and thus boosts engine efficiency. Additionally, thermally isolating the power cylinder from the external environment, according to exemplary embodiments of the present invention, limits external heat losses and thus enables a larger portion of the fuel heat energy to be converted into useful work, allows the reuse of heat energy in the next stroke, and therefore permits less fuel to be burned in each cycle.

Figure 10:
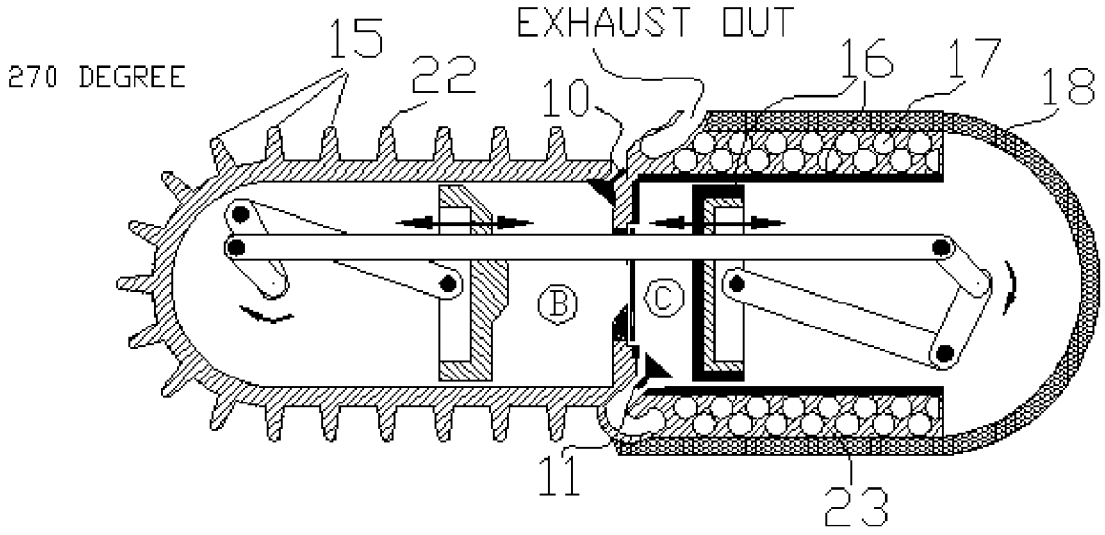
FIG. 10 is a simplified cross-sectional side view of a DPCE apparatus with an air-cooled compression cylinder and an exhaust-heated power cylinder composed of internal and external insulation materials, in accordance with exemplary embodiments of the present invention.

FIG. 10 illustrates exhaust heat capture and utilization during exhaust, in accordance with some embodiments of the present invention. The exhaust gas travels through passages 17, thereby conducting heat back into power cylinder 23. In addition, the various surfaces of chamber C may be both mechanically reinforced and thermally insulated by utilizing ceramic coats 16. Cylinder 23 may also utilize an external isolation cover 18 (e.g., honey structure or equivalent), which prevents heat leakage. Meanwhile, compression cylinder 22 temperatures may be reduced by utilizing heat diffusers 15.

Figure 11:
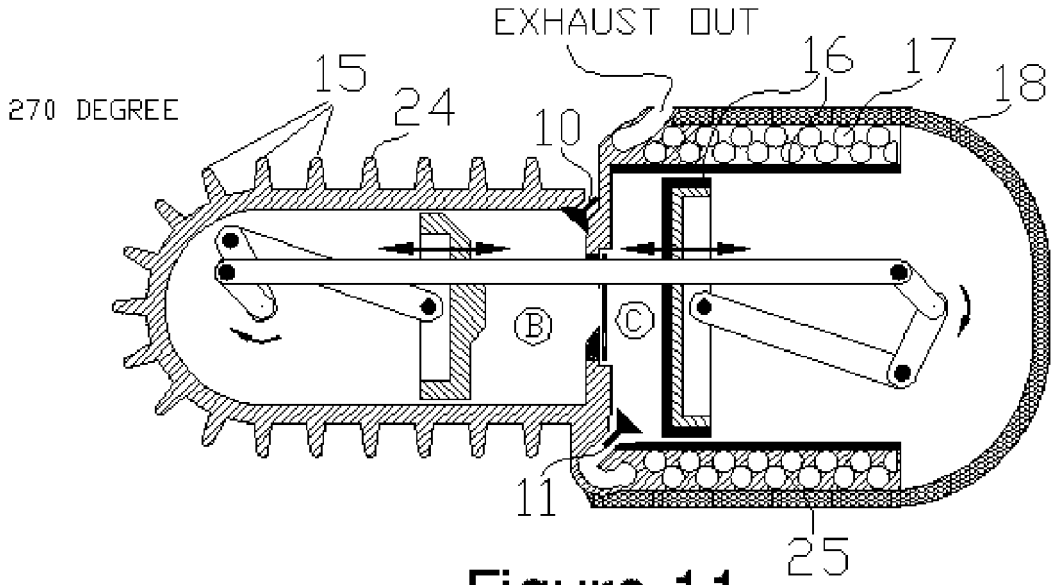
FIG. 11 is a simplified cross-sectional side view of the DPCE apparatus of FIG. 10 with a larger power cylinder expansion volume relative to engine compression volume, an air cooled compression chamber, and an exhaust-heated power chamber, in accordance with exemplary embodiments of the present invention.

FIG. 11 illustrates a method of providing a combustion engine with improved efficiency, in accordance with an exemplary embodiment. As illustrated, the intake and compression strokes, but not the exhaust stroke, are performed in a first cylinder 24 and the power and exhaust strokes, but not the intake stroke, are performed in a second cylinder 25, wherein the first cylinder internal volume B is smaller than the second cylinder internal volume C. Greater volume in the second cylinder internal volume C enables a larger expansion ratio in the second cylinder 25 than compression ratio in the first cylinder 24. The added expansion volume enables additional conversion of heat and pressure to mechanical work. The Double Piston Cycle Engine power cylinder may exercise higher temperatures relative to the cylinders of conventional engines and this extra expansion property carries significant gains in engine efficiency. In addition, in order to reduce compression temperatures, cylinder 22 (FIG. 10) may be equipped with heat diffuser elements 15.

An exemplary embodiment of an electromagnetic valve 112 will now be discussed with reference to FIGS. 12A-D. Electromagnetic valve 112 may be used as interstage valve 12 in the embodiments described above with respect to FIGS. 1-11 and, for illustrative purposes, the following description of electromagnetic valve 112 may refer to elements mentioned above in connection with FIGS. 1-11. It should be understood that use of electromagnetic valve 112 is not limited to the embodiments described above with respect to FIGS. 1-11, but may be used in other applications, including other types of double piston cycle engines, four-stroke engines, and compressors, for example.

Figure 12A:
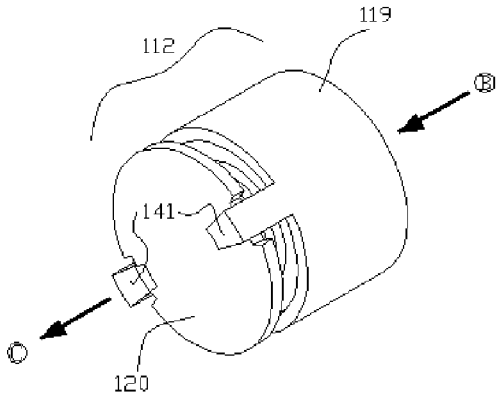
FIGS. 12A-D are simplified Three-Dimensional (3D) and 3D cross-sectional illustrations showing electromagnetic interstage valve operation in accordance with various exemplary embodiments of the present invention.

Referring to FIG. 12A, electromagnetic valve 112 may generally include main valve body 119 and seal 120. When used in the embodiments of FIGS. 1-11, electromagnetic valve 112 may separate compression chamber B and combustion chamber C. Each chamber may include regions of different fluid pressure. As used herein, the term "fluid" should be understood to include liquid and gaseous states. Electromagnetic valve 112 also includes seal 120 operable to decouple from main valve body 119 to allow fluid communication between chamber B and chamber C. As shown in FIG. 12A, mechanical stop 141 may be optionally included to limit the distance seal 120 can move away from main valve body 119. It should be understood that mechanical stop 141 is described by way of example and any number of mechanisms could be employed to limit the distance seal 120 can move away from valve body 119.

Figure 12B:
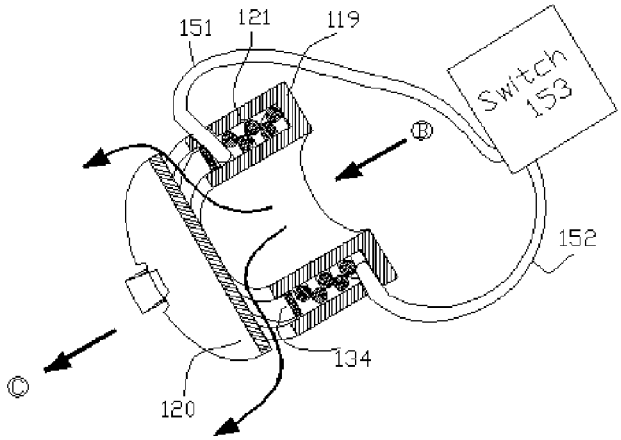

FIG. 12B is a cross-sectional view of electromagnetic valve 112. As shown in FIG. 12B, main valve body 119 may house electric coil 121. Electric coil 121 may be connected to an electric source by terminals 151 and 152, as shown in FIG. 12B. A switch 153 may also be used to vary the current applied to electric coil 121. Housing cover 134 may be included to enclose the coil within main valve body 119. In an exemplary embodiment, housing cover 134 can be fabricated from non-ferromagnetic material(s), such as brass, to insulate electric coil 121. In addition, main valve body 119 and/or seal 120 may be fabricated from ferromagnetic material(s).

Figure 12C:
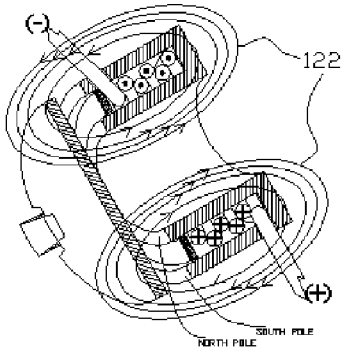

FIG. 12C, is a cross-sectional view of electromagnetic valve 112 in an open state. As shown in FIG. 12C, electrical current applied to electric coil 121 generates electromagnetic field 122. The electromagnetic field attracts seal 120 to main valve body 119, thereby generating a biasing force on seal 120 that biases the seal in a closed state (illustrated in FIG. 12D). In addition, other forces may be exerted on seal 120, such as, but not limited to, (1) a force resulting from pressure difference between chambers B and C (this difference can be referred to herein as a "pressure differential force") and (2) a net biasing force exerted on main valve body 119, including the electromagnetically generated biasing forces. In some embodiments, electromagnetic valve 112 may be in the open state when the pressure differential force overcomes the net biasing force exerted on seal 120, thereby causing seal 120 to move away from main valve body 119. In this and other exemplary embodiments, the pressure in chamber B is compression pressure in a double piston cycle engine. An exemplary advantage of this and other embodiments of the present invention is a decrease in the magnitude of the electromagnetically generated biasing forces as seal 120 moves away from main valve body 119. In further embodiments, when the pressure in chamber C exceeds the pressure in chamber B, a force is exerted on seal 120 causing seal 120 to move in the direction of main valve body 119. In this and other exemplary embodiments, the pressure in chamber C is combustion pressure in a double piston cycle engine. As seal 120 approaches main valve body 119, the magnitude of the electromagnetically generated biasing forces exerted on seal 120 increases, further biasing seal 120 in the direction of main valve body 119. An exemplary advantage of this embodiment is that when electromagnetic valve 112 is transitioning from the open state to the closed state, the force that biases seal 120 toward main valve body 119 is not the electromagnetically generated biasing force. Rather, the electromagnetic valve 112 uses the force exerted on seal 120 when the pressure in chamber C exceeds the pressure in chamber B. In this embodiment, the electromagnetically generated biasing force only biases the valve when the seal 120 is within a relatively close proximity to the main valve body.

Figure 12D:
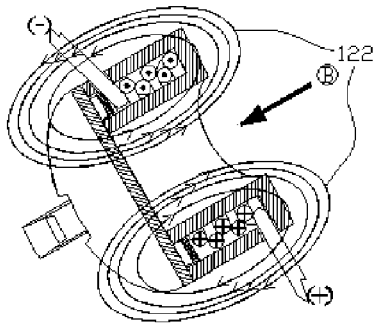

FIG. 12D is a cross-sectional view of electromagnetic valve 112 in a closed state. As shown in FIG. 12D, electromagnetic valve 112 may be in the closed state when the pressure differential force does not exceed a net biasing force on seal 120. In the closed state, seal 120 couples to main valve body 119 so as to prevent fluid communication between chamber B and chamber C. Seal 120 couples to main valve body 119 because electrical current applied to electric coil 121 creates opposing magnetic poles in an inner ring and an outer ring of main valve body 119 and the poles are then magnetically bridged by seal 120 Because the current applied to electric coil 121 controls the magnitude of the electromagnetically generated biasing force, the pressure differential necessary to open valve 112 may be controlled by adjusting current applied to the electric coil 121 via switch 153, as illustrated in FIG. 12B.

In one embodiment of the present invention, seal 120 can be configured to achieve maximum surface contact when coupled to main valve body 119. This arrangement produces stronger electromagnetically generated biasing forces because maximizing surface contact between seal 120 and main valve body 119 produces stronger magnetic bonds. In some embodiments, the current magnitude in electric coil 121 may be varied at different stages in the engine cycle to change the direction and/or magnitude of the electromagnetically generated biasing forces.

An exemplary embodiment of electromagnetic valve 112 will now be discussed with reference to FIGS. 13A-D. It should be understood that use of electromagnetic valve 112 is not limited to the DPCEs described herein, but may be used in other applications, including other types of double piston cycle engines, four-stroke engines, and compressors, for example.

Figure 13A:
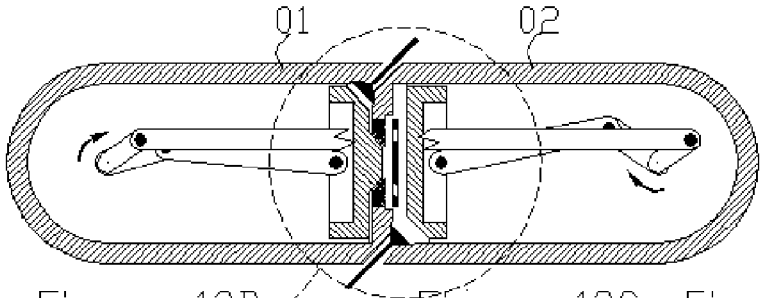
FIGS. 13A-D are simplified cross-sectional illustrations of an electromagnetic interstage valve illustrating various valve operating states.

FIG. 13A is a cross-sectional view of an engine similar to those described in FIGS. 1-11. As shown in FIG. 13A, the engine includes compression cylinder 01 and power cylinder 02.

Figure 13B:
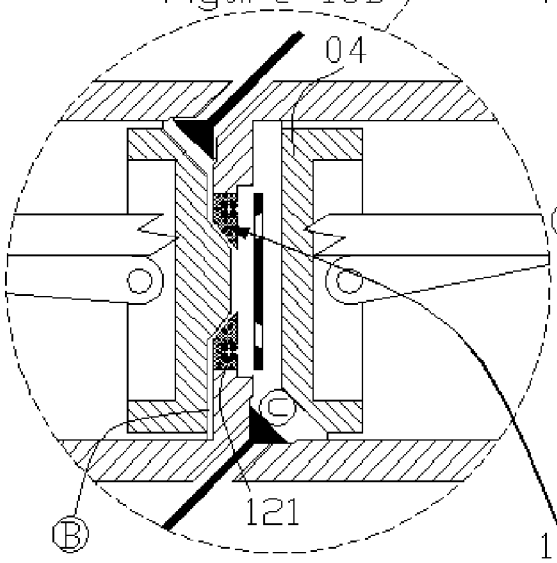

FIG. 13B is an expanded cross-sectional view of a region containing electromagnetic valve 112 similar to those described in FIGS. 1-11. As shown in FIG. 13B, chamber B may be located in compression cylinder 01, chamber C may be located in power cylinder 02, and electromagnetic valve 112 may be located between chamber B and chamber C.

Figure 13C:
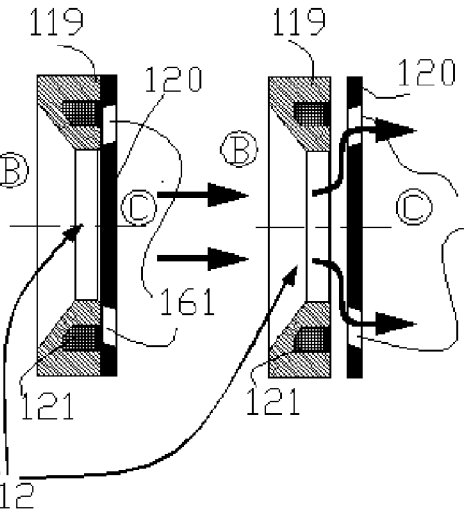

FIG. 13C is a cross-sectional view of electromagnetic valve 112 in a closed state. Electromagnetic valve 112 includes main valve body 119, seal 120, and electric coil 121. As shown in FIG. 13C, fluid communication between chamber B and chamber C can be prevented by electromagnetic valve 112 when in a closed state. Seal 120 may also include passages 161 that are obstructed when electromagnetic valve 112 is in a closed state. The electromagnetic valve may be in a closed state during the intake stroke described above with respect to the embodiments illustrated in FIGS. 1-11, for example.

Figure 13D:
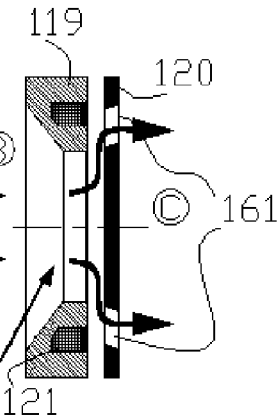

FIG. 13D is a cross-sectional view of electromagnetic valve 112 in an open state. As shown in FIG. 13D, seal 120 may include passages 161 that permit fluid communication between chamber B and chamber C when electromagnetic valve 112 is in an open state. Electromagnetic valve 112 may be in an open state between the compression and combustion strokes of the embodiments described above with respect to the embodiments illustrated in FIGS. 1-11, for example.

FIGS. 14A-D depicts an embodiment wherein a mechanical bias 131 is added to bias the electromagnetic valve 112. Mechanical bias 131 can exert an additional force biasing seal 120 in the direction of main valve body 119. In other words, the mechanical bias can generate a biasing force in addition to, or instead of, the electromagnetically generated biasing force discussed above. FIGS. 14A-D illustrate mechanical bias 131 as a leaf spring, but it should be understood that the mechanical bias can be other types of mechanical biasing, such as a connection to an engine component, a coil spring, or a seal shaped to resist movement, for example.

FIG. 14C is a cross-sectional view of electromagnetic valve 112 in a closed state. As shown in FIG. 14C, the net biasing force exerted on seal 120 biases the electromagnetic valve 112 in a closed state. The net biasing force may include electromagnetically and mechanically generated biasing forces.

FIG. 14D is a cross-sectional view of electromagnetic valve 112 in an open state. Electromagnetic valve 112 may be in an open state when the pressure differential force exceeds the net biasing force. As seal 120 moves away from main valve body 119, the magnitude of the electromagnetic generated biasing force decreases, thereby permitting seal 120 to move further away from main valve body 119. When the pressure in chamber C exceeds the pressure in chamber B, the resulting force exerted on seal 120 biases seal 120 in the direction of main valve body 119. In addition, the mechanically generated biasing force resulting from mechanical bias 131 may also bias seal 120 in the direction of main valve body 119. As seal 120 approaches main valve body 119, the magnitude of the electromagnetically generated biasing force may increase, coupling the seal 120 to the main valve body 119, as described above with reference to FIG. 14C.

A further exemplary embodiment of electromagnetic valve 212 is described with reference to FIGS. 15A-D. Electromagnetic valve 212 may be used as interstage valve 12 in the embodiments described above with respect to FIGS. 1-11 and, for illustrative purposes, the following description of electromagnetic valve 212 may refer to elements mentioned above in connection with FIGS. 1-11. It should be understood that use of electromagnetic valve 212 is not limited to the embodiments described below, but may be used in other applications, including other types of double piston cycle engines, four-stroke engines, and compressors, for example.

FIG. 15A is a cross-sectional view of a DPCE in accordance with an embodiment of the present invention. As shown in FIG. 15A, the engine includes compression cylinder 01 and power cylinder 02.

FIG. 15B is an expanded cross-sectional view of a region containing electromagnetic valve 212. As shown in FIG. 15B, chamber B may be located in compression cylinder 01, chamber C may be located in power cylinder 02, and electromagnetic valve 212 may be located between chamber B and chamber C.

FIG. 15C is a cross-sectional view of electromagnetic valve 212 in a closed state. As shown in FIG. 15C, electromagnetic valve 212 may include electric coil 221, main valve body 233, and poppet seal 232 including poppet member 234. Poppet seal 232 and main valve body 233 can be constructed from ferromagnetic alloys. Fluid communication between chamber B and chamber C can be prevented by electromagnetic valve 212 when in a closed state. Poppet seal 232 may also include passages 261 that are obstructed when electromagnetic valve 212 is in a closed state. In accordance with some embodiments, electromagnetic valve 212 may be in the closed state when the pressure differential force does not exceed the net biasing force exerted on poppet seal 232. Electromagnetic valve 212 may be in a closed state during the intake stroke of the engine.

FIG. 15D is a cross-sectional view of electromagnetic valve 212 in an open state. In accordance with some embodiments, electromagnetic valve 212 may be in the open state when the pressure differential force overcomes the net biasing force exerted on poppet seal 232, thereby allowing poppet seal 232 to move away from main valve body 233. As shown in FIG. 15D, poppet seal 232 may optionally include passages 261. When in an open state, fluid communication between chamber B and chamber C may be permitted through passages 261. Electromagnetic valve 212 may be in an open state between the compression and combustion strokes of the engine. Because current applied to the electric coil 221 controls the magnitude of magnetic force acting on poppet seal 232, the force differential necessary to enable fluid communication between chamber B and chamber C may be controlled by adjusting the current applied to electric coil 221. A stop 241 may be optionally included to limit the distance poppet seal 232 can move away from main valve body 233. It should be understood that stop 241 is included by way of example and any number of mechanisms could be employed to limit the distance poppet seal 232 can move away from valve body 233. In some embodiments, poppet seal 232 couples to stop 241 when in an open state. Poppet seal 232 may couple to stop 241 when electrical current applied to electric coil 221 creates opposing magnetic poles, one pole orientation is from the inner ring of main valve body 233, which is conducted through poppet member 234, and the other pole orientation is from the outer ring of main valve body 233 conducted through stop 241. The poles are then magnetically bridged by poppet seal 232 and stop 241, where a magnetic bridge extends from inner to outer rings of main valve body 233.

It should be understood that interstage valve 12 is not limited to the embodiments described above with respect to FIGS. 12-15, but may also include other valve structures, such as mechanically biased valves or valves which can be manipulated by switching mechanisms dependent on crankshaft angle, similar to mechanical electrical ignition timing devices known in the art. When employing switching device mechanisms in conjunction with the electromagnetic valve described in FIGS. 12-15, current applied to electric coils 121 and 221 may vary so as to vary the electromagnetic biasing force exerted on the valve.

In some embodiments, cooling arrangements may be added to control and cool the electromagnetic valve and electric coil temperatures by using, for example, oil, water, or air.

In some embodiments, engine performance data may be collected and processed to further optimize performance of the electromagnetic valve.

In some embodiments, the current magnitude in an electric coil may be varied at different stages in the engine cycle to change the magnitude and/or direction of the electromagnetically generated biasing forces.

Figure 16:
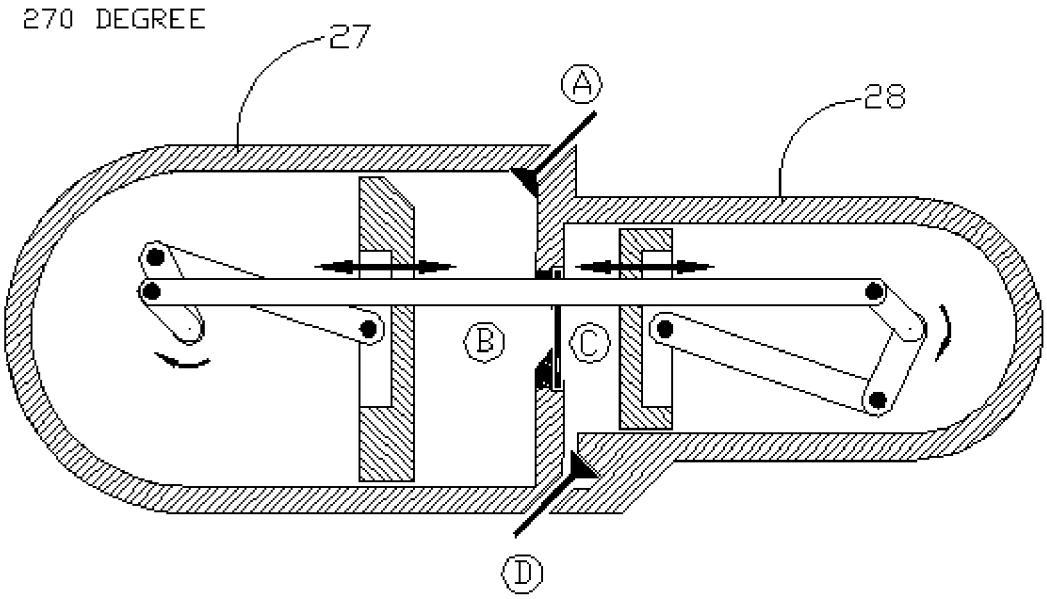
FIG. 16 is a simplified cross-section illustration of a DPCE apparatus with supercharged capabilities, in accordance with exemplary embodiments of the present invention.

Referring now to FIG. 16, illustrated therein is a DPCE dual cylinder configuration having supercharged capabilities, in accordance with exemplary embodiments of the present invention. As shown in FIG. 16, the volume of compression cylinder 27 is larger than the volume of power cylinder 28, thereby allowing a greater volume of air/fuel mixture to be received and compressed in the compression chamber B. During the compression stroke, the larger volume and increased pressure of compressed air/fuel mixture (i.e., "supercharged" fuel mixture) in the compression chamber B is injected into the combustion chamber C via interstage valve 12. Therefore, a greater amount and/or higher pressure of fuel mixture can be injected into the combustion chamber C of power cylinder 28 to provide a bigger explosion and, hence, provide more energy and work, during the power stroke.

Figure 17:
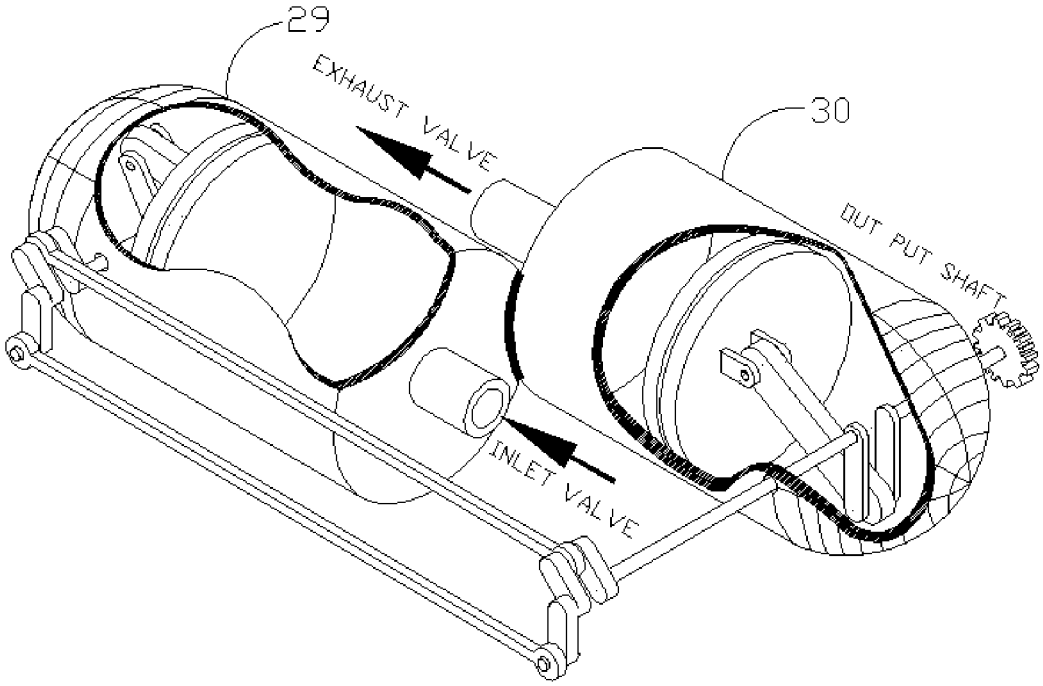
FIG. 17 is a simplified 3D illustration of a DPCE apparatus with the compression cylinder and the power cylinder on different planes, in accordance with exemplary embodiments of the present invention.

FIG. 17 illustrates an alternative DPCE dual cylinder configuration, in accordance with exemplary embodiments of the invention, wherein the compression cylinder 29 is offset from the power cylinder 30, to provide minimal thermal conductivity between the two cylinders. In this embodiment, the interstage valve 12 may be located in a small area of overlap between the two cylinders (not shown).

Figure 18:
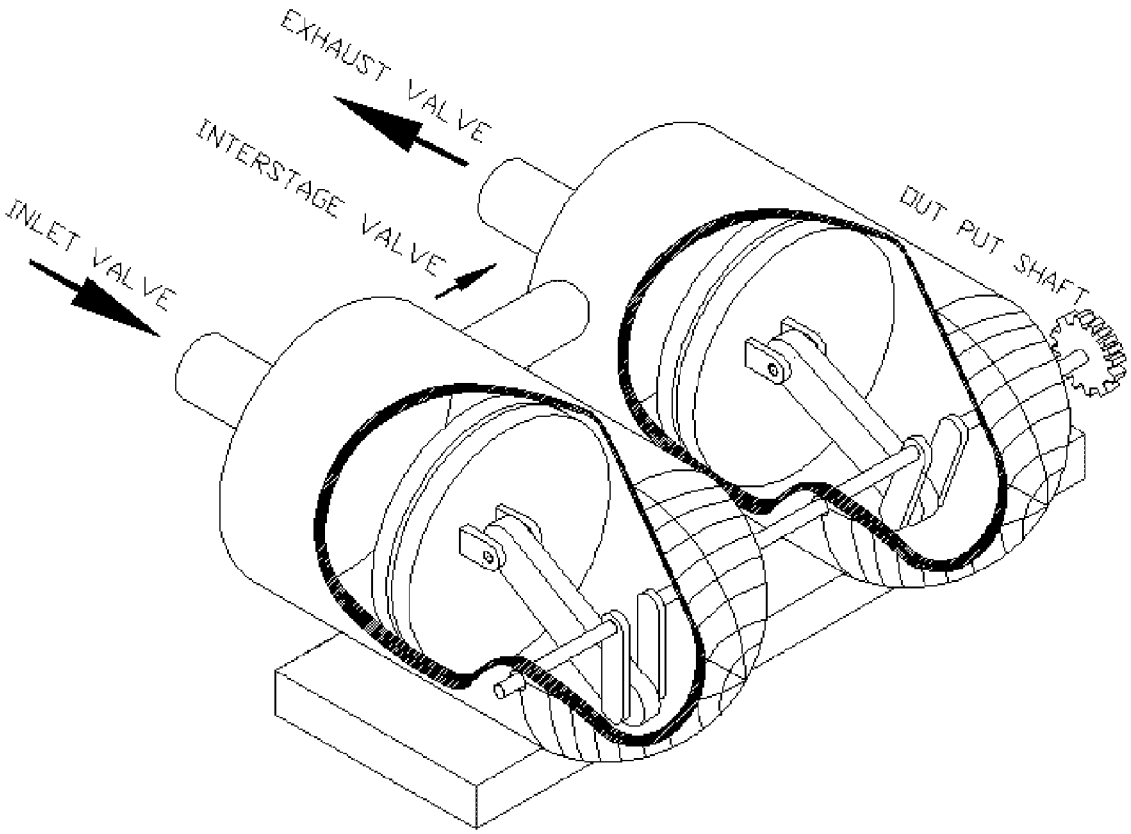
FIG. 18 is a simplified 3D illustration of a DPCE apparatus in which both cylinders are parallel to each other and both pistons move in a tandem manner, in accordance with exemplary embodiments of the invention.

FIG. 18 illustrates a DPCE dual cylinder configuration in which both cylinders are constructed parallel to each other and both pistons are moving in a tandem manner, in accordance with exemplary embodiments of the present invention. In this embodiment, the intake, exhaust, and interstage valves may operate in the same manner as described above. However, as shown in FIG. 18, the interstage valve is located in a lateral conduit that couples the first and second cylinders.

Figure 19:
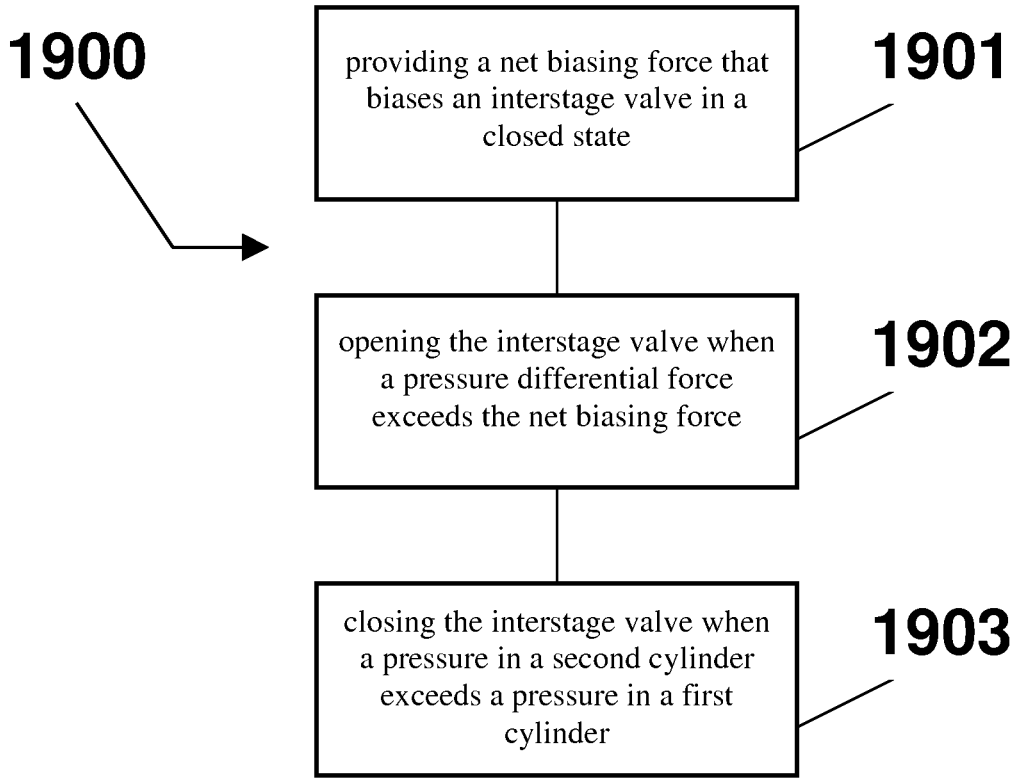
FIG. 19 is a simplified block-diagram of a process for operating a combustion engine, in accordance with exemplary embodiments of the invention.

FIG. 19 is a block diagram of a process 1900 of operating an interstage valve of a combustion engine, according to an exemplary embodiment of the present invention. It should be appreciated that process 1900 may include any number of additional or alternative tasks. The tasks shown in FIG. 19 need not be performed in the illustrated order, and process 1900 may be incorporated into a more comprehensive procedure or process having additional functionality not described in detail herein. Process 1900 may be implemented using the embodiments illustrated in FIGS. 1-18 and, for illustrative purposes, the following description of process 1900 may refer to elements mentioned above in connection with FIGS. 1-18.

As shown in FIG. 19, process 1900 includes providing 1901 a net biasing force that biases an interstage valve (for example, interstage valve 12 described in FIGS. 1-9 or electromagnetic valves 112 and 212 described in FIGS. 12-15) in a closed state. In one embodiment, the net biasing force includes an electromagnetically generated biasing force. In accordance with some embodiments, the net biasing force may also include a mechanically generated biasing force. Step 1901 may also include applying a current to an electric coil (for example, electric coils 121 and 221 described in FIGS. 12-15) to generate the electromagnetically generated biasing force. In addition, step 1901 may also include performing an intake stroke and part of a compression stroke, but not an exhaust stroke, using a first piston (for example piston 03 in FIGS. 1-16) housed in a first cylinder (for example cylinder 01 in FIGS. 1-16) of the combustion engine and performing a combustion stroke and an exhaust stroke, but not an intake stroke, using a second piston (for example piston 04 in FIGS. 1-16) housed in a second cylinder of the combustion engine (for example cylinder 02 in FIGS. 1-16).

As also shown in FIG. 19, process 1900 includes opening 1902 the interstage valve when a pressure differential force exceeds the net biasing force, wherein the pressure differential force includes the force generated by a pressure differential between a first cylinder and a second cylinder of the combustion engine. Step 1902 may include increasing the pressure differential force near the end of a compression stroke, such as when the exhaust valve closes, or shortly thereafter, for example. Step 1902 may also include moving a seal of the interstage valve (for example, seals 120 and 232 described in FIGS. 12-15) to a position defined by a mechanical stop (for example, mechanical stops 141 and 241 described in FIGS. 12 and 15). In addition, step 1902 may include decoupling the seal from a body of the interstage valve (for example, bodies 119 and 230 described in FIGS. 12-15).

As also shown in FIG. 19, process 1900 includes closing 1903 the interstage valve when a pressure in the second cylinder exceeds a pressure in the first cylinder. Step 1903 may also include coupling a seal of the interstage valve to a body of the interstage valve.

Figure 20:
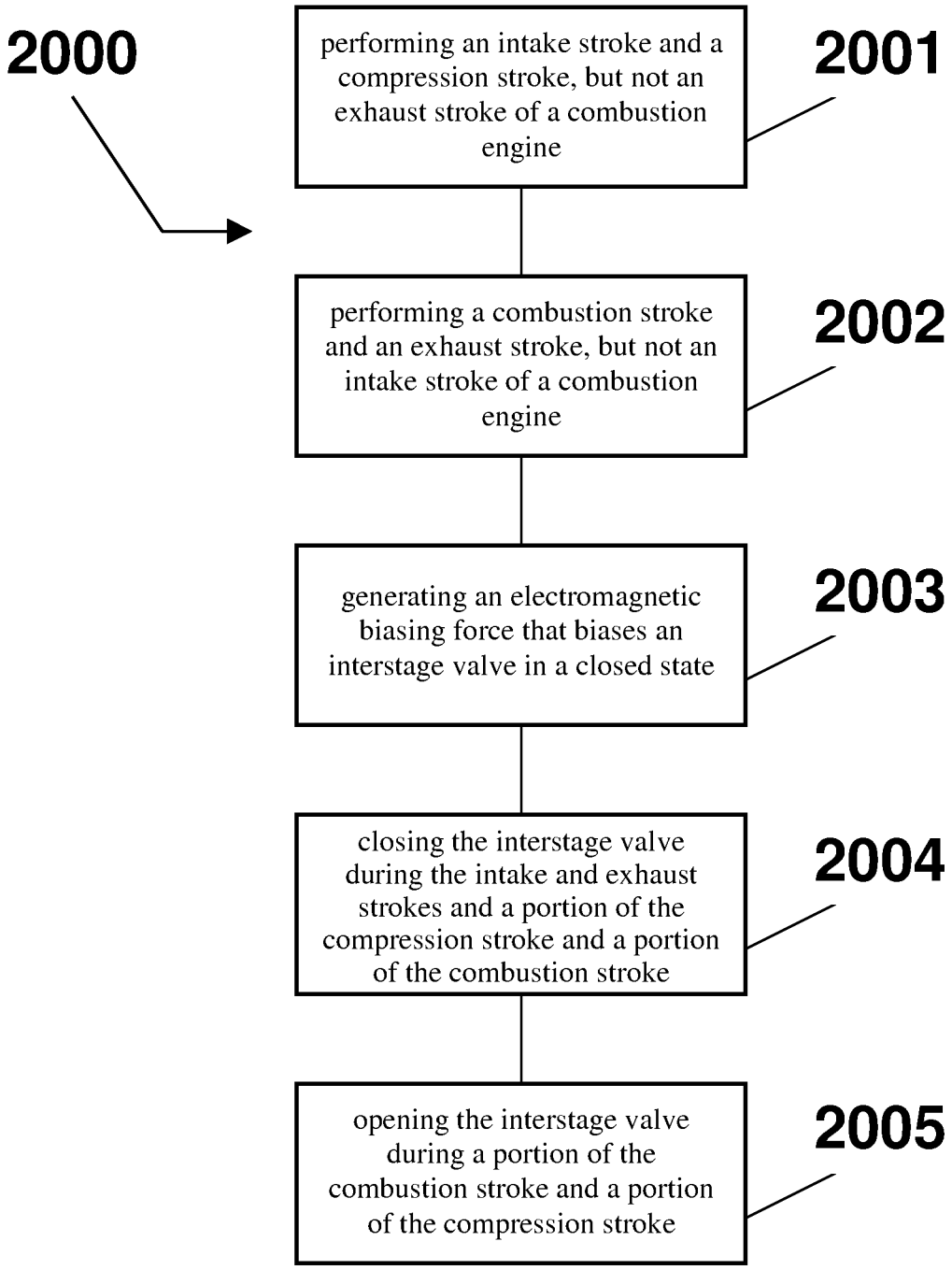
FIG. 20 is a simplified block-diagram of a process for operating a combustion engine, in accordance with exemplary embodiments of the invention.

FIG. 20 is a block diagram of a process 2000 of operating a combustion engine, according to an exemplary embodiment of the present invention. It should be appreciated that process 2000 may include any number of additional or alternative tasks. The tasks shown in FIG. 20 need not be performed in the illustrated order, and process 2000 may be incorporated into a more comprehensive procedure or process having additional functionality not described in detail herein. Process 2000 may be implemented using the embodiments illustrated in FIGS. 1-18 and, for illustrative purposes, the following description of process 2000 may refer to elements mentioned above in connection with FIGS. 1-18.

As shown in FIG. 20, process 2000 includes performing 2001 an intake stroke and a compression stroke, but not an exhaust stroke, using a first piston (for example piston 03 in FIGS. 1-16) housed in a first cylinder (for example cylinder 01 in FIGS. 1-16) of the combustion engine.

As also shown in FIG. 20, process 2000 includes performing 2002 a combustion stroke and an exhaust stroke, but not an intake stroke, using a second piston housed in a second cylinder using a second piston (for example piston 04 in FIGS. 1-16) housed in a second cylinder of the combustion engine (for example cylinder 02 in FIGS. 1-16).

As also shown in FIG. 20, process 2000 includes generating 2003 an electromagnetically generated biasing force that biases an interstage valve (for example, interstage valve 12 described in FIGS. 1-9 or electromagnetic valves 112 and 212 described in FIGS. 12-15) in a closed state. Step 2003 may include applying a current to an electric coil (for example, electric coils 121 and 221 described in FIGS. 12-15) to generate the electromagnetically generated biasing force. Step 2003 may also include applying a mechanically generated biasing force to a seal of the interstage valve (for example, seals 120 and 232 described in FIGS. 12-15) so as to bias the seal in the direction of a body of the interstage valve (for example, bodies 119 and 230 described in FIGS. 12-15).

As also shown in FIG. 20, process 2000 includes closing 2004 the interstage valve during the intake and exhaust strokes and during a portion of the compression stroke and a portion of the combustion stroke. Step 2004 may include coupling a seal of the interstage valve to a body of the interstage valve.

As also shown in FIG. 20, process 2000 includes opening 2005 the interstage valve during a portion of the combustion stroke and during a portion of the compression stroke. Step 2005 may include moving a seal of the interstage valve to a position defined by a mechanical stop (for example, mechanical stops 141 and 241 described in FIGS. 12 and 15). Step 2005 may also include decoupling the seal from a body of the interstage valve.

In some embodiments of the processes described with respect to FIGS. 19 and 20, the current magnitude in the electric coil may be varied at different stages in the engine cycle to change the magnitude and/or direction of the electromagnetically generated biasing forces.

While various embodiments of the invention have been illustrated and described, those of ordinary skill in the art will appreciate that the above descriptions of the embodiments are exemplary only and that the invention may be practiced with modifications or variations of the devices and techniques disclosed above. Those of ordinary skill in the art will know, or be able to ascertain using no more than routine experimentation, many equivalents to the specific embodiments of the invention described herein. Such modifications, variations, and equivalents are contemplated to be within the spirit and scope of the present invention as set forth in the claims below.

What is claimed is:

1. A combustion engine, comprising:

a first cylinder housing a first piston therein, wherein the first piston performs an intake stroke and a compression stroke, but does not perform an exhaust stroke;

a second cylinder housing a second piston therein, wherein the second piston performs a combustion stroke and an exhaust stroke, but does not perform an intake stroke; and an interstage valve located between the first and second cylinders so as to selectively fluidly couple the first and second cylinders, wherein a net biasing force biases the interstage valve in a closed state, the net biasing force comprising an electromagnetically generated biasing force.

2. The combustion engine of claim 1, wherein the interstage valve is in the closed state when a pressure differential force does not exceed the net biasing force, the pressure differential force comprising the force generated by a pressure differential between the first and second cylinders, and the interstage valve is in an open state when the pressure differential force exceeds the net biasing force.

3. The combustion engine of claim 1, wherein the interstage valve further comprises:

a body;

a seal; and an electric coil configured to generate the electromagnetically generated biasing force, wherein the electromagnetically generated biasing force biases the seal toward the body.

4. The combustion engine of claim 3, wherein:

the electric coil is housed in the body;

the body further comprises a cover positioned between the electric coil and the seal, wherein the cover is constructed of non-ferromagnetic material; and the seal and the body are constructed of ferromagnetic material.

5. The combustion engine of claim 3, wherein the seal is operable to move from the closed state to an open state, the open position defined by a mechanical stop.

6. The combustion engine of claim 3, wherein the net biasing force further comprises a mechanically generated biasing force.

7. The combustion engine of claim 6, wherein the mechanically generated biasing force is generated by a mechanical biasing mechanism selected from a group consisting of: a leaf spring, a connection to an engine component, a coil spring, and a seal shaped to resist movement.

8. The combustion engine of claim 3, wherein the seal further comprises a poppet member configured to magnetically couple a positive magnetic pole of the body and a negative magnetic pole of the body.

9. The combustion engine of claim 3, wherein the seal defines a passage, the passage configured to enable fluid communication between the first and second cylinder when the interstage valve is in an open state.

10. The combustion engine of claim 3, further comprising a switch configured to vary the current applied to the electric coil at different stages of a cycle of the combustion engine.

11. The combustion engine of claim 1, further comprising:

a first crankshaft coupled to the first piston;

a second crankshaft coupled to the second piston;

a crankshaft connecting mechanism coupled to the first and second crankshafts and configured to translate motion between the first and second crankshafts, the crankshaft connecting mechanism comprising a crankshaft connecting rod having first and second ends coupled to the first and second crankshafts, respectively;

the first and second cylinders thermally isolated from one another and the first cylinder maintained at a cooler temperature than the second cylinder during operation; and the first and second cylinders fluidly coupled to minimize dead space between the first and second cylinders.

12. The combustion engine of claim 11, wherein the first and second cylinders are located parallel and in tandem to each other such that at least a portion of a top surface of the first cylinder is adjacent to and fluidly coupled to at least a portion of a top surface of the second cylinder.

13. The combustion engine of claim 11, wherein the first and second cylinders are positioned to form a V configuration and the interstage valve is located in an area of spatial overlap between the first and second cylinders.

14. The combustion engine of claim 11, wherein the first cylinder further comprises a plurality of air cooling ribs located on an external surface of the first cylinder and a plurality of liquid cooling passages within its housing.

15. The combustion engine of claim 11, wherein the second cylinder further comprises a plurality of exhaust heating passages for utilizing heat provided by exhaust gases expelled by the second piston to further heat the second cylinder and is thermally isolated from the surrounding environment so as to reduce leakage of thermal energy from the second cylinder.

16. The combustion engine of claim 11, wherein an internal volume of the first cylinder is greater than an internal volume of the second cylinder.

17. The combustion engine of claim 11, wherein an internal volume of the first cylinder is less than an internal volume of the second cylinder.

18. The combustion engine of claim 11, wherein the first and second pistons move simultaneously in-phase or out-of-phase with one another within their respective first and second cylinders.

19. A combustion engine, comprising:

a first cylinder;

a second cylinder; and an interstage valve located between the first and second cylinders so as to selectively permit fluid communication between the first and second cylinders, the interstage valve comprising:

a body;

a seal; and an electric coil, wherein the seal is coupled to the body so as to prevent fluid communication between the first and second cylinders when a pressure differential force does not exceed a net biasing force exerted on the seal, wherein the pressure differential force comprises a force generated by a pressure differential between the first and second cylinders and wherein the net biasing force comprises an electromagnetically generated biasing force generated by the electric coil.

20. The combustion engine of claim 19, wherein the interstage valve is configured to decouple from the body so as to permit fluid communication between the first and second cylinders when the pressure differential force exceeds the net biasing force.

21. The combustion engine of claim 19, wherein:

the electric coil is housed in the body;

the body further comprises a cover positioned between the electric coil and the seal, wherein the cover is constructed of non-ferromagnetic material; and the seal and the body are constructed of ferromagnetic material.

22. The combustion engine of claim 19, wherein the net biasing force further comprises a mechanically generated biasing force.

23. The combustion engine of claim 19, wherein the seal is configured to have passages, the passages configured to permit fluid communication between the first and second cylinder when the seal is not coupled to the body.

24. The combustion engine of claim 19 further comprising:

a first piston housed in the first cylinder for performing an intake stroke and a compression stroke, but not an exhaust stroke; and a second piston housed in the second cylinder for performing a combustion stroke and an exhaust stroke, but not an intake stroke.

25. The combustion engine of claim 24 further comprising a switch configured to vary the current applied to the electric coil at different stages of a cycle of the combustion engine, so that the seal is coupled to the body during the intake, compression, and exhaust strokes and the seal is not coupled to the body during all or a portion of the combustion stroke.

* * * * *